US009669286B2

(12) United States Patent
Thieler et al.

(10) Patent No.: US 9,669,286 B2
(45) Date of Patent: Jun. 6, 2017

(54) PROCESS AND TOOL FOR APPLICATION OF WAX ONTO WATERSPORT BOARDS

(71) Applicants: Elise Thieler, Rockledge, FL (US); Michael A. Johnson, Rockledge, FL (US)

(72) Inventors: Elise Thieler, Rockledge, FL (US); Michael A. Johnson, Rockledge, FL (US)

( * ) Notice: Subject to any disclaimer, the term of this patent is extended or adjusted under 35 U.S.C. 154(b) by 0 days.

(21) Appl. No.: 15/134,961

(22) Filed: Apr. 21, 2016

(65) Prior Publication Data

US 2016/0310826 A1 Oct. 27, 2016

Related U.S. Application Data

(60) Provisional application No. 62/151,090, filed on Apr. 22, 2015.

(51) Int. Cl.
*A47L 13/02* (2006.01)
*A63C 11/08* (2006.01)

(52) U.S. Cl.
CPC ..... *A63C 11/08* (2013.01); *A47L 13/02* (2013.01)

(58) Field of Classification Search
CPC . A47L 13/02; A47L 13/08; A47J 17/02; A47J 43/25; A63C 11/08
See application file for complete search history.

(56) References Cited

U.S. PATENT DOCUMENTS

| | | | | | |
|---|---|---|---|---|---|
| 2,265,012 | A * | 12/1941 | Earp | A47G 21/023 | 30/129 |
| 3,195,598 | A * | 7/1965 | Koch | A47J 19/00 | 241/168 |
| 3,441,070 | A * | 4/1969 | Loughlin | A47J 43/25 | 241/84.4 |
| 7,343,639 | B2 * | 3/2008 | Dranginis | A47L 13/02 | 15/236.01 |
| 7,694,381 | B2 * | 4/2010 | Heaslet | A63C 11/08 | 15/105 |
| 8,671,502 | B2 * | 3/2014 | Nazzari | B63B 35/7933 | 15/236.08 |
| 2008/0086829 | A1 * | 4/2008 | Adams | A63C 11/08 | 15/236.01 |
| 2010/0242745 | A1 * | 9/2010 | Smith | A47J 43/25 | 99/567 |
| 2012/0170964 | A1 * | 7/2012 | Bogdanoff | B25F 1/04 | 401/52 |

* cited by examiner

*Primary Examiner* — Randall Chin
(74) *Attorney, Agent, or Firm* — Robert M. Downey, P.A.

(57) ABSTRACT

A process and tool for the application of wax onto watersport boards including, but not limited to, surfboards, longboards, foam top boards, skim boards, standup paddle boards, boogie boards, wake skateboards, and wake surfboards. The process includes shredding wax with the use of a handheld grating device having a cutting blade with grating holes. The process further includes distributing the grated wax fragments onto the surface of the watersport board while continuing to rub the wax over the cutting blade of the grating device and layering the grated wax fragments over areas of the board surface where grip is needed, and then gently pressing the wax fragments onto the surface of the board to create a texture for ideal grip and traction needed to stand on and control the watersport board. One or more scraper edges on the grating device allow for removal of the wax from the board surface.

2 Claims, 7 Drawing Sheets

PROCESS AND TOOL FOR APPLICATION OF WAX ONTO WATERSPORT BOARDS

BACKGROUND OF THE INVENTION

Field of the Invention

The present invention relates to a process and tool for application of wax to the surface of watersport boards, such as surfboards, foam top boards, skim boards, standup paddle boards and the like, for creating texture and providing better grip and traction.

Discussion of the Related Art

The exposed surfaces of watersport boards can be extremely slippery when wet, thereby making it extremely difficult to stand on and control the watersport board during use. In order to improve traction and grip, it is well known to apply wax to the surface areas of a watersport board, such as a surfboard, where the hands and feet make contact during normal use. Traditionally, application of wax to surfboards and other watersport boards has been accomplished by rubbing a block or bar of wax directly on the surface areas of the board where the grip is needed. This method of application requires wax to be removed from the block and adhered to the board surface as a result of the friction created by moving the wax bar across the board surface. This process can be time consuming and typically involves the need to apply a base coat and then one or more subsequent coats in order to achieve a sufficient layer of wax application on the board surface. Depending upon the material composition of the board surface, it may be difficult to cause the wax to be removed from the block or bar and adhered to the board surface. For instance, application of wax to foam top boards can be extremely difficult and troublesome. When rubbing a wax block or bar over the surface of the foam top board, the wax typically does not remove from the block or bar and adhere to the foam board.

The traditional method of application of wax to watersport board surfaces does not create a significant texture for ideal traction. Moreover, during use of the watersport board, the applied wax quickly becomes smooth and loses a significant level of grip and traction. A wax comb is typically used in order to restore grip and provide increased texture for better traction. The wax comb includes teeth that are moved over the surface of the previously applied wax to create better texture. This process requires further time and often does not provide ideal results. Eventually, the wax needs to be scraped from the surface of the watersport board, using a scraper tool. The removed wax is discarded and is cannot be reused. A new layer of wax must be applied by again rubbing the wax block or bar on the board surface, as described above.

Considering the shortcomings and limitations of the conventional method of applying wax to watersport boards, there remains a need for a new and improved process for application of wax onto watersport boards that is more efficient, less time consuming and creates better texture and traction than the conventional wax application method. Moreover, there remains a need for a new and improved process for application of wax onto watersport board surfaces wherein the wax can be removed and reapplied to the watersport board surface.

OBJECTS AND ADVANTAGES OF THE INVENTION

Considering the forgoing, it is a primary object of the present invention to provide a new process for the application of wax onto watersport boards including, but not limited to, surfboards, longboards, foam top boards, skim boards, standup paddle boards, wake skate boards, and wake surfboards, and wherein the wax application process creates better texture and traction compared to the conventional wax application method.

It is a further object of the present invention to provide a new process for the application of wax onto watersport boards is more efficient and less time consuming (i.e., approximately 40% faster than the traditional wax application method).

It is still a further object of the present invention to provide a new process and tool for the application of wax onto watersport boards, and wherein the wax can be removed and reapplied using the grating tool of the present invention.

It is still a further object of the present invention to provide a new process for the application of wax onto watersport boards, and wherein the wax can be easily applied to foam top boards.

These and other objects and advantages of the present invention are readily apparent with reference to the detailed description and accompanying drawings.

SUMMARY OF THE INVENTION

The present invention is directed to a new process and tool for the application of wax onto watersport boards including, but not limited to, surfboards, longboards, foam top boards, skim boards, standup paddle boards, wake skate boards, and wake surfboards to create traction formed by various levels of grated wax. The process of the present invention involves shredding wax with the use of a handheld grating tool. The grated wax fragments are layered onto the board's surface to create a texture that is ideal for traction needed to stand on and control watersport boards.

The tool of the present invention includes a cutting blade for grating the wax into the shredded wax fragments. In a preferred embodiment, the cutting blade has bi-directional grating holes for shredding the wax in each direction as the wax block is rubbed in a back and forth reciprocating action over the cutting blade. The bi-directional blade is ideal for fast application and preventing wax buildup on the grater. The holes in the cutting blade can be designed in various dimensions and formats to produce a variety of different shapes and textures depending on wax selection and user preference. Examples of the cuts of wax fragments include fine, coarse, ribbons, discs, curly strings and pebble fragments. The tool of the present invention includes a tapered scraper edge to remove the wax from the board surface when needed. Once removed, the wax can be compressed into a ball shape and reused for application to the watersport board surface according to the process of the present invention. The tool may further include curved scraper edges for removing wax from the rails of the watersport board, such as the rails of a surfboard.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 8:
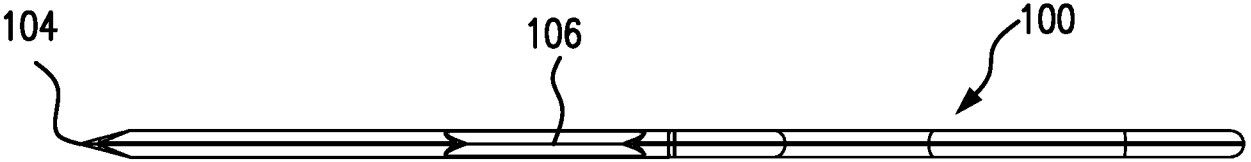
FIG. 8 is a side elevational view of the grater tool shown in FIG. 7.
Figure 7:
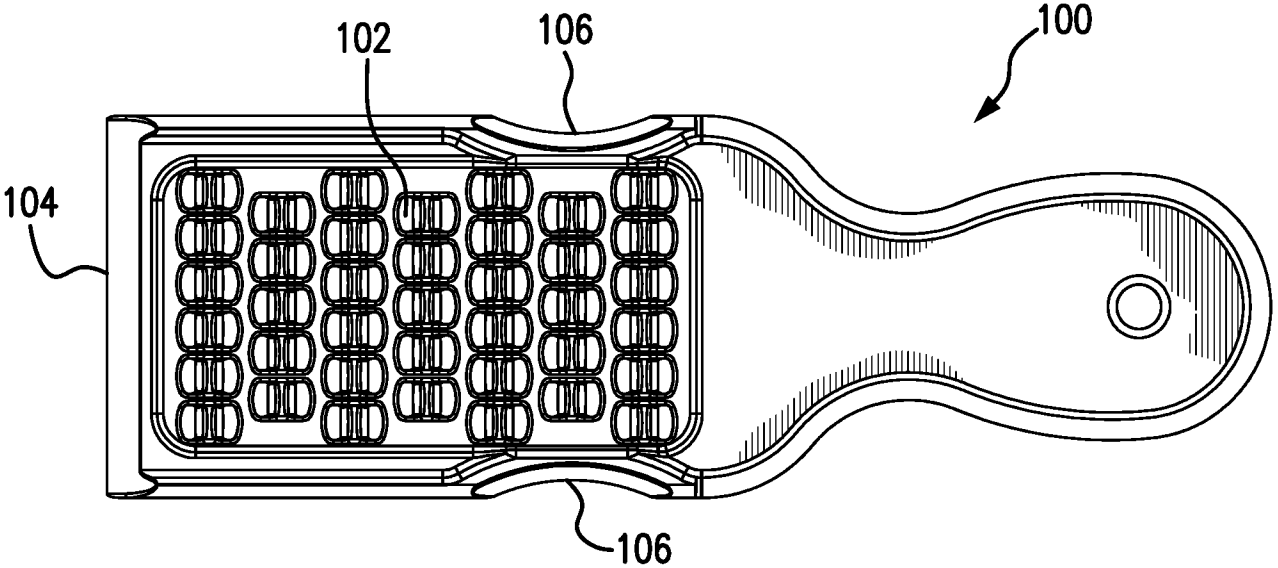
FIG. 7 is a top plan view of the grater tool of the present invention used for application and removal of wax to the watersport board according to the process of the present invention.

Referring initially to FIGS. 7 and 8, the tool of the present invention is shown in accordance with a preferred embodiment and is generally indicated as 100. The tool 100 is specifically structured and intended for application of wax onto the surface of watersport boards such as, but not limited to, surfboards, longboards, foam top boards, skim boards, standup paddle boards, boogie boards, wake skateboards, and wake surfboards according to the method of the present invention, as described in more detail hereinafter. The tool 100 is also structured for removal of the wax from the surface of watersport boards. The tool 100 includes a grating blade 102 for grating wax from a wax block 130 or other form of a unitary mass of wax material. The grating blade 102 is specifically structured for grating the wax into shredded wax fragments. In a preferred embodiment, the grating blade has bi-directional grating holes for shredding the wax in each direction as the wax block or other accumulated mass of wax material is rubbed in a back and forth reciprocating action over the grating blade 102. The bi-directional grating blade is preferred for fast wax application to the watersport board while preventing wax buildup on the grater blade 102. The holes in the grating blade are designed to produce a particular shape and texture of shredded wax in accordance with a user preference.

Figure 1:
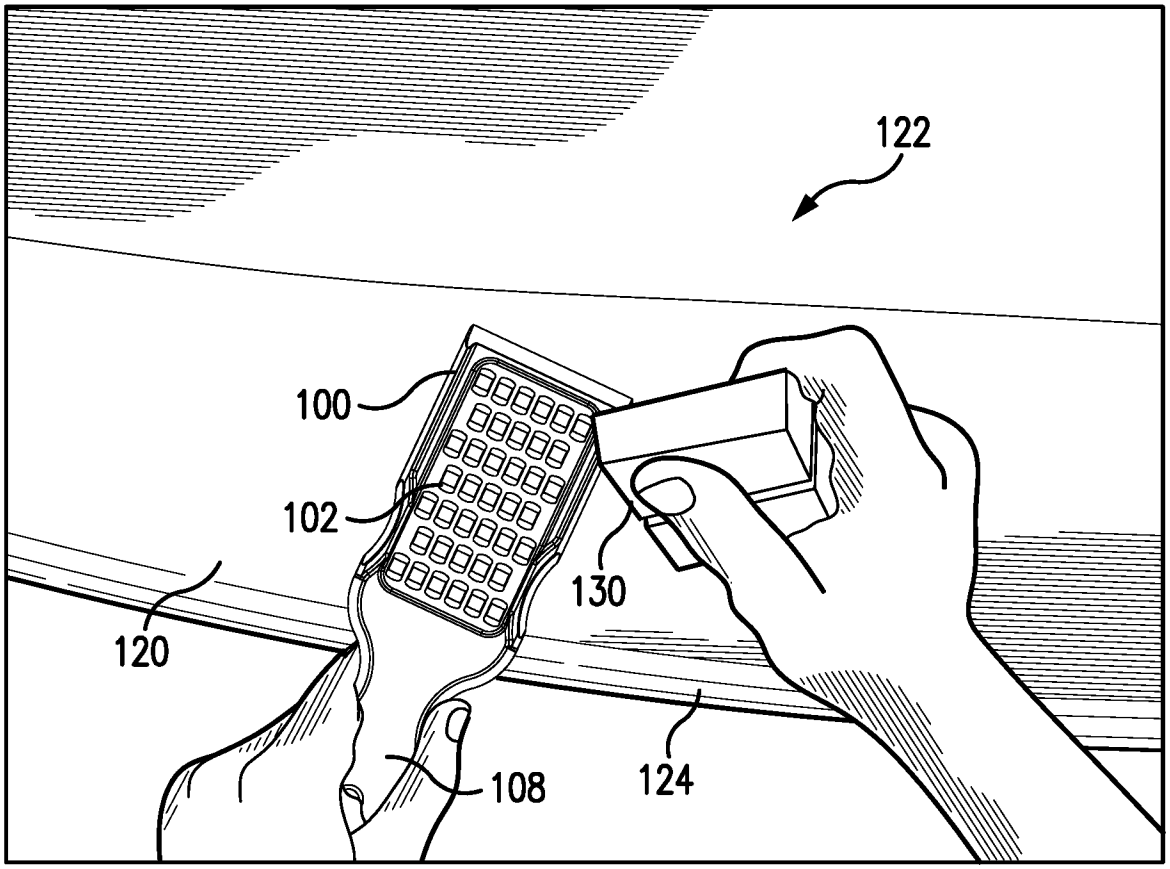
FIGS. 1-5 illustrate a sequence of steps for application of wax to a watersport board surface using a grater tool according to the process of the present invention.
Figure 2:
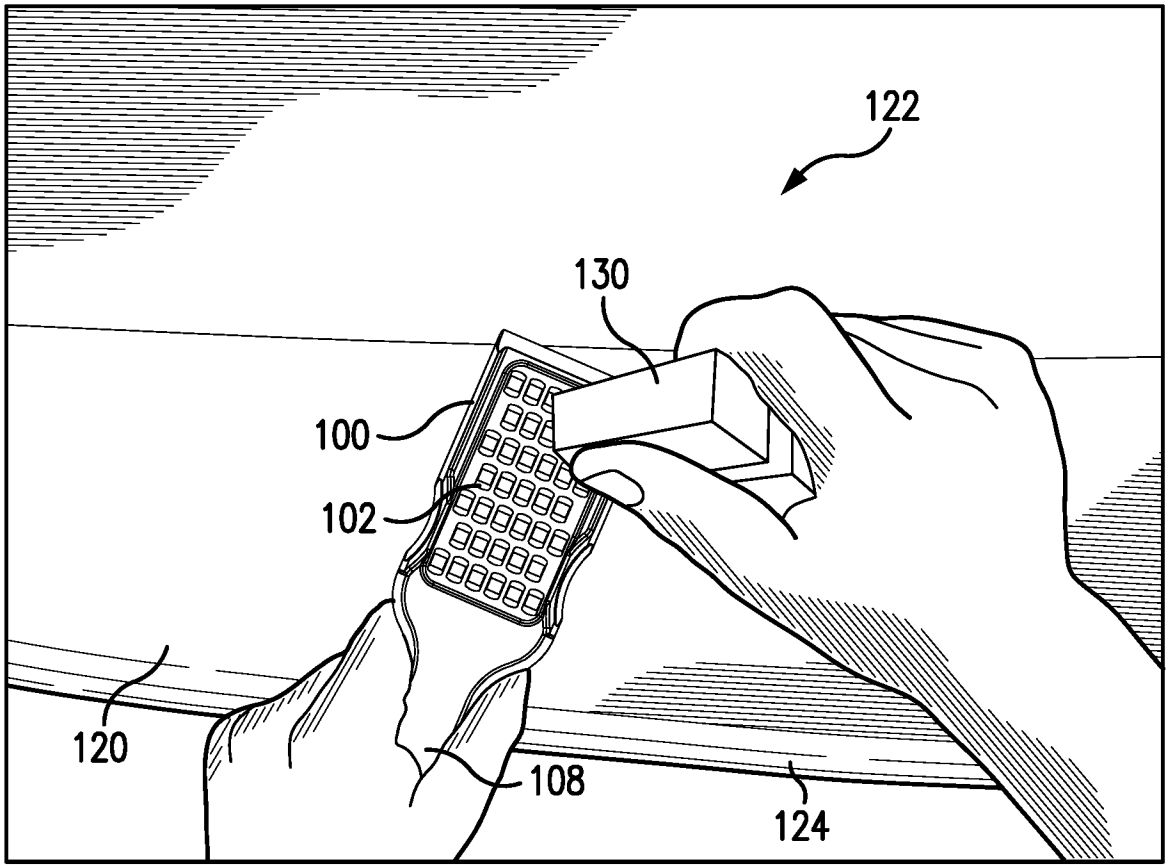

The tool 100 further includes a tapered scraper edge 104 along a distal edge of the tool. The scraper edge is used for removing the wax from the surface of the watersport board as necessary. In a preferred embodiment, the tool further includes curved scraper edges 106 on opposite sides for removing wax from the curved surfaces or rails of a watersport board, such as the rails of a surfboard. As seen in FIGS. 1 and 2, a handle portion 108 of the tool 100 allows for ergonomic grasping of the tool within one hand of the user.

Referring to FIGS. 1-5, a sequence of steps for the process of application of wax onto the surface 120 of a watersport board 122 is shown according to the process of the present invention. A detailed description of the process is as follows:

Step 1. Referring to FIG. 1, hold the wax grating tool 100 at the handle 108 in the non-dominant hand and the block of wax 130 in the dominant hand approximately 4-6 inches above the surface 120 to which the wax is being applied.

Step 2. Referring to FIG. 2, hold the wax block 130 at an angle relative to the grating blade surface of the grating tool 100 and rub the wax block 130 back and forth over the bi-directional grating blade 102 (see FIG. 8), while pressing the wax block 130 gently against the grating blade surface. Each pass of the wax block 130 over the grating blade 102 will cut into the wax and create smaller pieces or wax fragments 140 below the blade (see FIG. 3). As the user continues the back and forth motion with the wax against the grater blade, the grated wax fragments 140 will begin to fall from the underside of the grating blade 102, landing on the surface 120 below the grating tool 100 (i.e., the surface of the watersport board).

Figure 3:
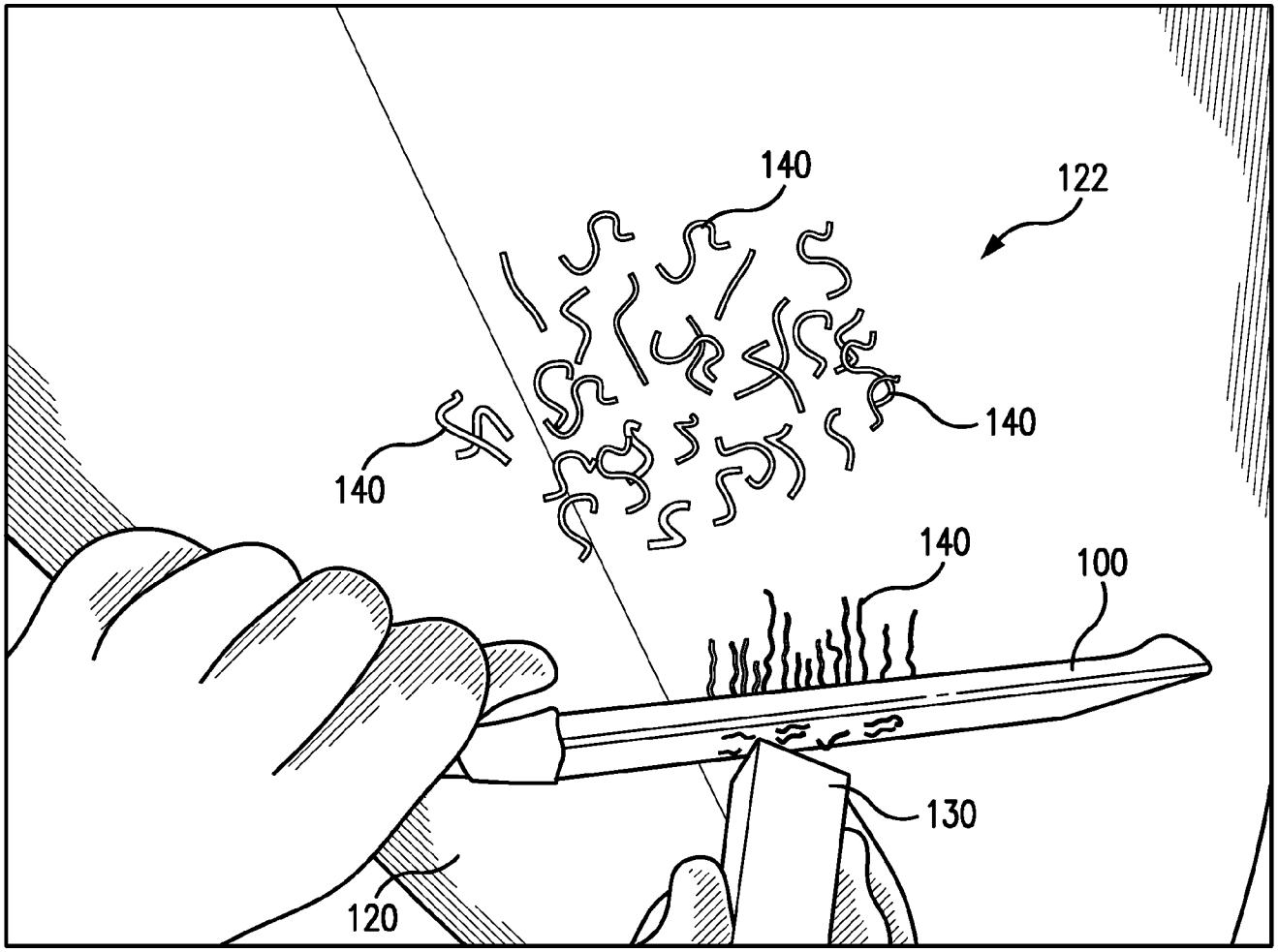

Step 3. Referring to FIG. 3, while holding the grating tool 100 at approximately 4-6 inches above the surface 120, continue rubbing the wax block 130 back and forth over the grating blade 102. As the user moves the grater tool 100 over the surface 120 of the board 122, the fragments 140 will fall onto the desired areas. Recommended areas for application are any surface locations on the board 122 that the hands and feet normally make contact and grip as needed during use (e.g., when surfing). This area may differ depending on user preference and the type of equipment being waxed.

Figure 4:
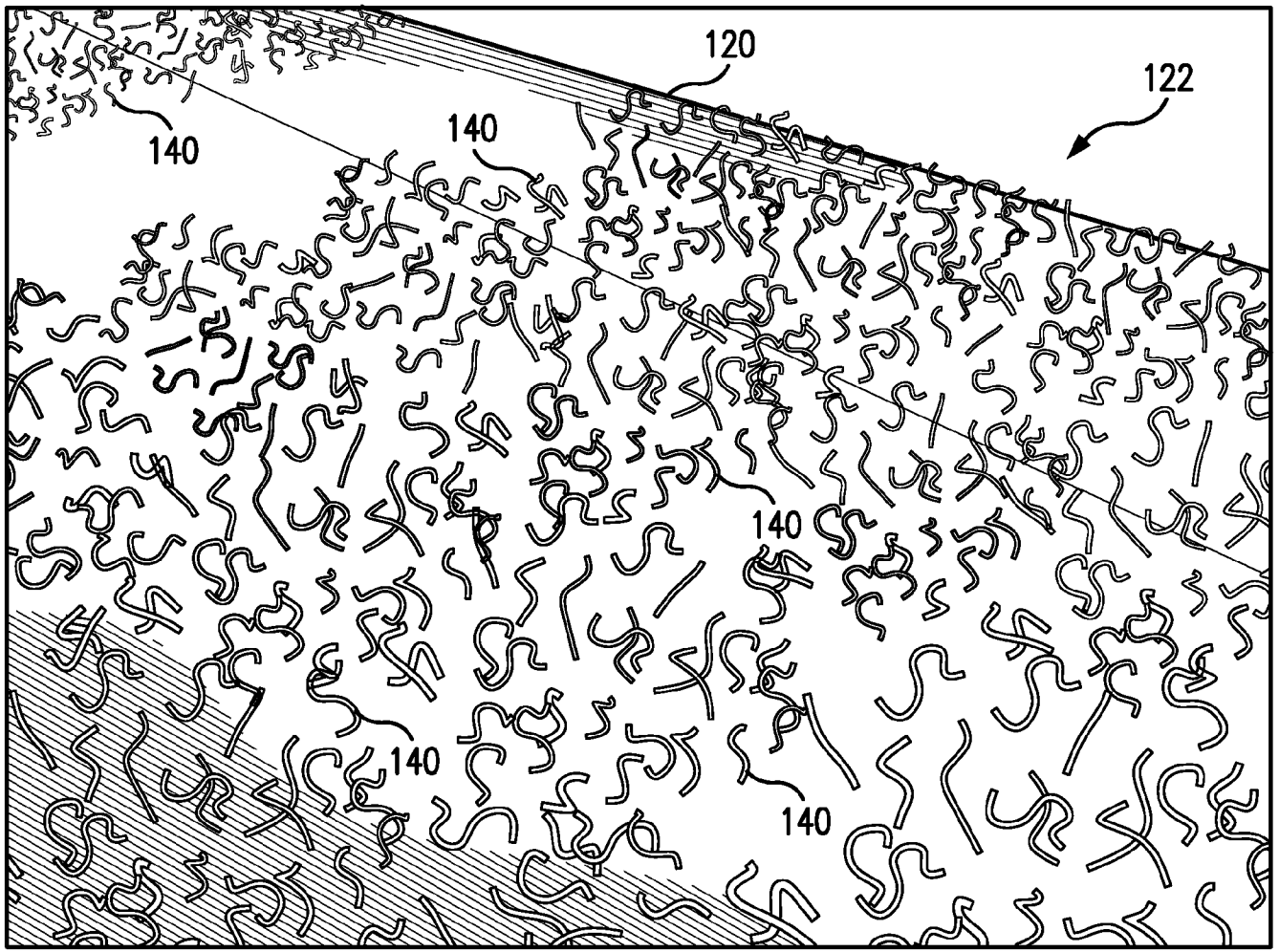

Step 4. Referring to FIG. 4, continue the grating process until the desired thickness of wax and texture on the surface 120 of the board 122 is accomplished.

Figure 5:
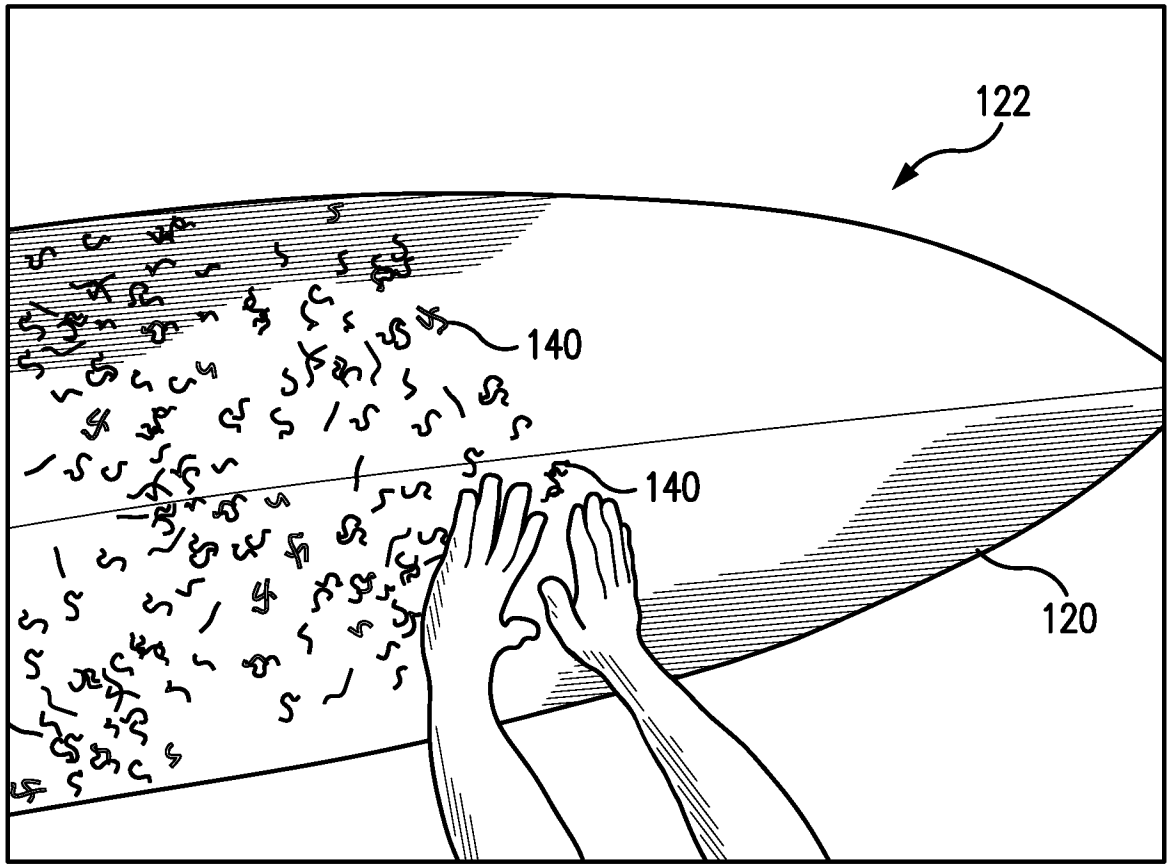

Step 5. Referring to FIG. 5, after completing the desired thickness and texture of the wax, gently press the wax fragments 140 onto the surface 120 of the watersport board 122. This will allow the wax fragments 140 to better adhere to the board surface, creating a better grip.

Once the wax as been applied according to the steps of the process as set forth above, the watersport board 122 can be used and enjoyed with the added grip and traction. When more texture is needed to improve the grip, the user can continue the steps of the process as set forth above. The amount of grip and traction will vary depending on user preference and usage.

Figure 6:
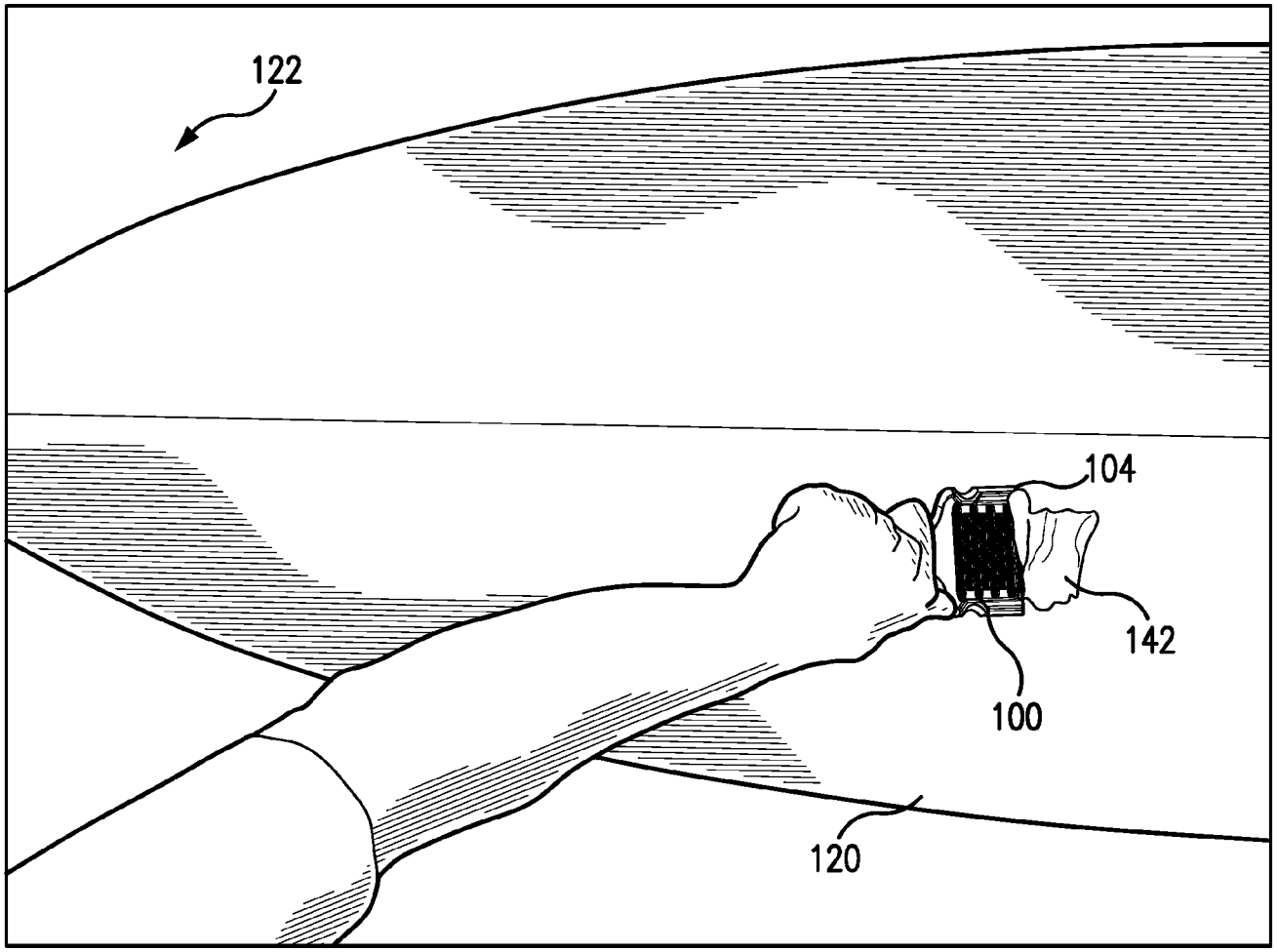
FIG. 6 illustrates use of a scraper edge on the grater tool for removing previously applied wax from the watersport board.

Over time, the wax will lose its texture and grip and will need to be removed and replaced. When this is necessary, the scraper edge 104 of the grating tool 100 of the present invention (see FIGS. 7 and 8) is used to remove the wax from the surface of the board. This is done by sliding the angled scraper edge 104 of the tool 100 along the surface 120 of the watersport board 122 which will cause the wax to peel off, as shown in FIG. 6. After the wax is removed from the board 122 or other equipment, the user can either reuse the wax or use new wax. If the wax is to be reused, the user will need to compress the removed wax into a ball shape and repeat steps 1-5, as set forth above. Alternatively, if a new bar of wax is used, the user simple repeats steps 1-5 of the process of the present invention, as set forth above, to apply the new wax to the watersport board 122. The curved scraper edges 106 of the tool 100 are used for removing wax from curved edges 124 of the watersport board 122, such as the rails of a surfboard.

While the present invention has been shown and described in accordance with a preferred and practical embodiment thereof, it is recognized that departures from the instant disclosure are fully contemplated within the spirit and scope of the invention.

What is claimed is:

1. A method of applying wax to a watersport board comprising the steps of:

providing a tool including:

a main body including a proximal handle portion, a distal edge, and opposite side edges extending between the distal edge and the proximal handle portion;

a grating blade on the main body between the proximal handle portion and the distal edge and the grating blade including a plurality of grating holes structured and disposed for cutting and shredding wax from a unitary mass of wax material to produce a plurality of wax fragments of a particular shape and texture;

a tapered scraper blade along the distal edge structured and disposed for scraping and removing wax from a surface; and at least one curved scraper blade on at least one of the opposite side edges of the main body for scraping and removing wax from a curved surface;

holding the tool in one hand and the unitary mass of wax material in the other hand while maintaining the tool above the surface of the watersport board to which the wax is being applied;

moving the unitary mass of wax material over the grating blade while pressing the unitary mass of wax material gently against the grating blade to cause the plurality of wax fragments to be cut from the unitary mass of wax material;

allowing the plurality of wax fragments to fall onto the surface of the watersport board;

continuing to move the unitary mass of wax material against the grating blade while moving the tool over the surface of the watersport board to cause the plurality of wax fragments to fall and be distributed throughout the desired area of wax application on the surface of the watersport board; and gently pressing the plurality of wax fragments with at least one hand onto the surface of the watersport board to cause the plurality of wax fragments to adhere to the surface.

2. A method of applying wax to a watersport board comprising the steps of:

providing a tool including:

a main body including a proximal handle portion, a distal edge, and opposite side edges extending between the distal edge and the proximal handle portion;

a grating blade on the main body between the proximal handle portion and the distal edge and the grating blade including a plurality of bi-directional grating holes structured and disposed for cutting and shredding wax from a unitary mass of wax material to produce a plurality of wax fragments of a particular shape and texture as the unitary mass of wax material is moved both in a first direction against the grating blade and an opposite second direction against the grating blade;

a tapered scraper blade along the distal edge structured and disposed for scraping and removing wax from a surface; and at least one curved scraper blade on at least one of the opposite side edges of the main body for scraping and removing wax from a curved surface;

holding the tool in one hand and the unitary mass of wax material in the other hand while maintaining the tool above the surface of the watersport board to which the wax is being applied;

moving the unitary mass of wax material over the grating blade in both the first direction and the opposite second direction while pressing the unitary mass of wax material gently against the grating blade to cause the plurality of wax fragments to be cut from the unitary mass of wax material as the unitary mass of wax material is moved in both the first and second directions;

allowing the plurality of wax fragments to fall onto the surface of the watersport board;

continuing to move the unitary mass of wax material against the grating blade in both the first and second directions while moving the tool over the surface of the watersport board to cause the plurality of wax fragments to fall and be distributed throughout the desired area of wax application on the surface of the watersport board; and gently pressing the plurality of wax fragments with at least one hand onto the surface of the watersport board to cause the plurality of wax fragments to adhere to the surface.

* * * * *